US009234145B2

(12) United States Patent
Banerjee et al.

(10) Patent No.: US 9,234,145 B2
(45) Date of Patent: Jan. 12, 2016

(54) HYDROPROCESSING AND APPARATUS RELATING THERETO

(71) Applicant: UOP LLC, Des Plaines, IL (US)

(72) Inventors: Soumendra Mohan Banerjee, Dwarka (IN); Mani Krishna, Chennai (IN); Avnish Kumar, Alwar (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 14/824,652

(22) Filed: Aug. 12, 2015

(65) Prior Publication Data

US 2015/0344791 A1 Dec. 3, 2015

Related U.S. Application Data

(62) Division of application No. 13/850,399, filed on Mar. 26, 2013, now Pat. No. 9,127,218.

(51) Int. Cl.
*B01J 8/04* (2006.01)
*C10G 67/02* (2006.01)

(52) U.S. Cl.
CPC ..... *C10G 67/02* (2013.01)

(58) Field of Classification Search
CPC ..... B01J 8/04; B01J 8/0446; B01J 8/0449; B01J 8/0453; B01J 8/0469; B01J 8/0476; B01J 8/048; C10G 65/02; C10G 65/10; C10G 65/12; C10G 69/02
See application file for complete search history.

(56) References Cited

U.S. PATENT DOCUMENTS 6,251,263 B1 * 6/2001 Hatanaka ..... B01J 8/04 208/210

* cited by examiner

*Primary Examiner* — Brian McCaig
(74) *Attorney, Agent, or Firm* — James C. Paschall

(57) ABSTRACT

One exemplary embodiment can be a process for hydroprocessing. The process can include providing a hydroprocessing zone having at least two beds, and quenching downstream of a first bed of the at least two beds with a first vacuum gas oil that may be lighter than another vacuum gas oil fed to the first bed.

2 Claims, 1 Drawing Sheet

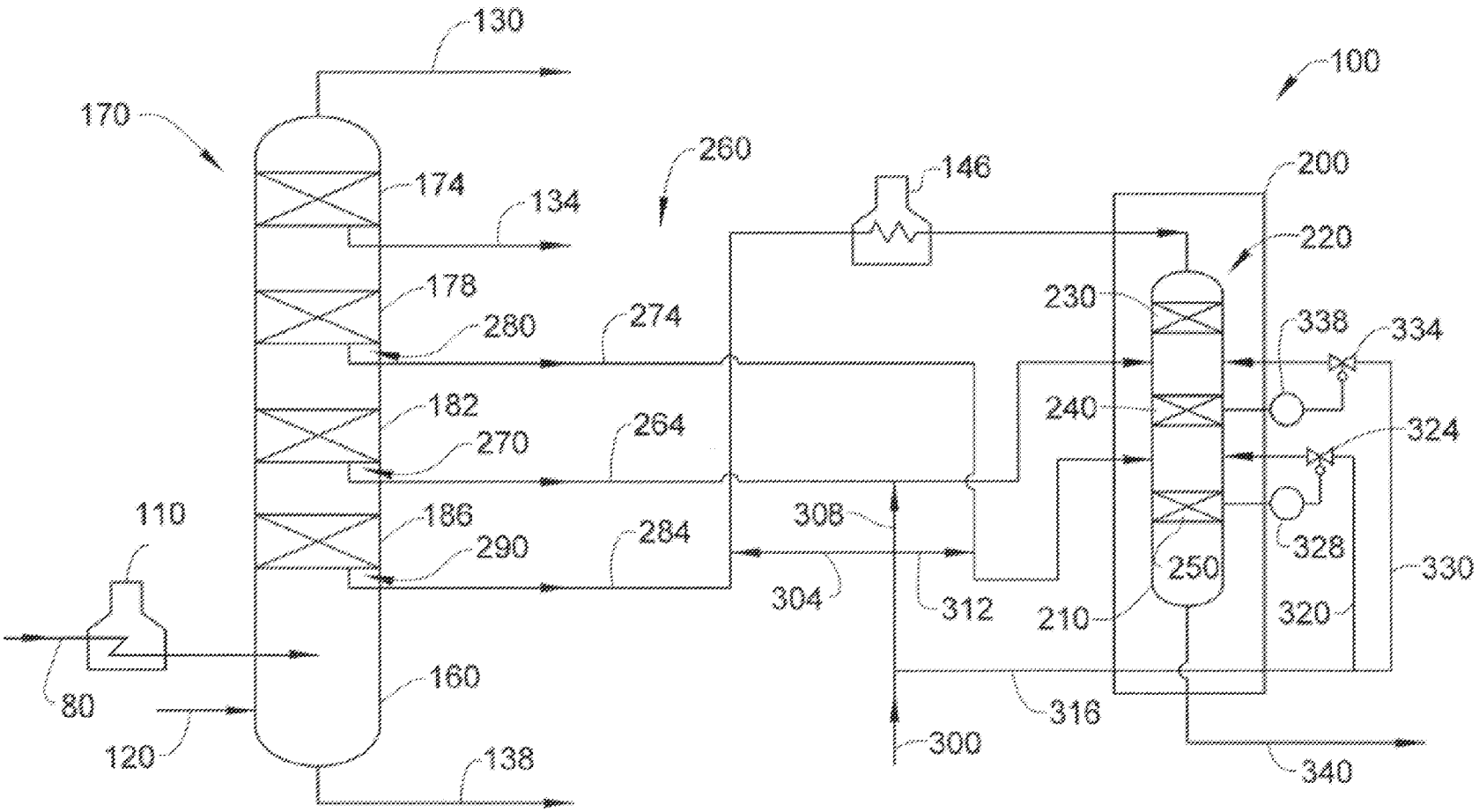
100
200
220
338
334
324
328
330
320
340
250
230
240
210
316
146
312
300
308
304
260
274
264
284
130
134
174
178
280
182
270
186
290
160
138
170
110
120
80

HYDROPROCESSING AND APPARATUS RELATING THERETO

CROSS-REFERENCE TO RELATED APPLICATION

This application is a Division of copending application Ser. No. 13/850,399 filed Mar. 26, 2013, the contents of which are hereby incorporated by reference in its entirety.

FIELD OF THE INVENTION

This invention generally relates to hydroprocessing and an apparatus relating thereto.

DESCRIPTION OF THE RELATED ART

Many refineries have an existing configuration routing the crude column bottom stream from an atmospheric distillation column to a secondary processing unit such as a fluidized cracking unit or a delayed coking unit. However, stringent fuel specifications are typically forcing these refineries to increasingly opt for using hydroprocessing units to produce high quality middle distillates such as diesel and kerosene. Often, a vacuum gas oil is also subjected to hydrocracking to reduce the hydrocarbon chain size, thereby converting the hydrocarbons to more valuable products. Usually, a quench gas, usually from a recycle gas compressor, is provided as needed to control the hydrocracking process. However, heating the entire vacuum gas oil and pumping the quench gas, adds expense to the process. Hence, there is a desire to further improve such processes for minimizing energy and utility requirements for producing these distillates.

SUMMARY OF THE INVENTION

One exemplary embodiment can be a process for hydroprocessing. The process can include providing a hydroprocessing zone having at least two beds, and quenching downstream of a first bed of the at least two beds with a first vacuum gas oil that may be lighter than another vacuum gas oil fed to the first bed.

Another exemplary embodiment can be a hydroprocessing apparatus. The hydroprocessing apparatus can include a vacuum distillation column, a hydroprocessing reactor, and a plurality of lines. The hydroprocessing reactor can include a first bed, a second bed, and a third bed. The plurality of lines may have a first line and a second line. The first line can be for withdrawing a first stream from a first location in the vacuum distillation column and communicating the first stream downstream of the first bed. The second line may be for withdrawing a second stream from a second location in the vacuum distillation column and communicating the second stream downstream of the second bed. Generally, the first location is at a lower elevation on the vacuum distillation column than the second location.

Another exemplary embodiment may be a process for hydroprocessing. The process can include sending an atmospheric bottoms stream to a vacuum distillation column providing a first stream having one or more $C_{26}$-$C_{36}$ hydrocarbons, a second stream having one or more $C_{24}$-$C_{25}$ hydrocarbons, and a third stream having one or more $C_{36}$-$C_{52}$ hydrocarbons. Typically, the hydroprocessing reactor contains a first bed, a second bed, and a third bed. Usually, the first stream is sent downstream of the first bed and upstream of the second bed, the second stream is sent downstream of the second bed and upstream of the third bed, and the third stream is sent to the hydroprocessing reactor.

The embodiments herein can provide an LVGO, an MVGO, and an HVGO to a hydroprocessing zone. The HVGO can be provided to a reactor charge furnace upstream of the hydroprocessing zone, rather than all three oils being fed through the furnace. Hence, heater duty can be minimized and operation costs lowered. Moreover, the MVGO and LVGO may be routed without cooling from the vacuum distillation column. The MVGO and LVGO can serve as a liquid quench to hydroprocessing reactor beds, and thus, may minimize quench gas requirements. This minimization may, in turn, reduce the power requirement of a recycle gas compressor. Additionally, splitting the oils and providing them at different locations within the hydroprocessing reactor can allow altering the quantity and quality of the bed catalyst depending on the type of feed provided thereto. Furthermore, revamping an existing hydroprocessing apparatus to heat only the HVGO can lower the pressure drop across the reactor charge furnace, and allow increases in charge rates.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and nonaromatic hydrocarbons. Moreover, the hydrocarbon molecules may be abbreviated $C_1$, $C_2$, $C_3$ . . . $C_n$ where "n" represents the number of carbon atoms in the one or more hydrocarbon molecules. Furthermore, a superscript "+" or "−" may be used with an abbreviated one or more hydrocarbons notation, e.g., $C_3^+$ or $C_3^-$, which is inclusive of the abbreviated one or more hydrocarbons. As an example, the abbreviation "$C_3^+$" means one or more hydrocarbon molecules of three carbon atoms and/or more. A "stream" may also be or include substances, e.g., fluids, other than hydrocarbons, such as hydrogen.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "hydroprocessing" can refer to processing one or more hydrocarbons in the presence of hydrogen, and can include hydrotreating and/or hydrocracking.

As used herein, the term "hydrocracking" can refer to a process breaking or cracking bonds of at least one long-chain hydrocarbon in the presence of hydrogen and at least one catalyst into lower molecular weight hydrocarbons.

As used herein, the term "hydrotreating" can refer to a process including contacting a hydrocarbon feedstock with hydrogen gas in the presence of one or more suitable catalysts for the removal of heteroatoms, such as sulfur, nitrogen and metals from a hydrocarbon feedstock. In hydrotreating, hydrocarbons with double and triple bonds may be saturated, and aromatics may also be saturated, as some hydrotreating processes are specifically designed to saturate aromatics.

As used herein, the term "vacuum distillation" can refer to a process for distilling a stream, typically a bottom stream, from an atmospheric distillation column, by using pressure of less than about 101.3 KPa to facilitate boiling and distillation.

As used herein, the term "vacuum gas oil" can include one or more $C_{22}$-$C_{52}$ hydrocarbons and boil in the range of about 340° to about 590° C. or about 340° to about 560° C. at about 101.3 KPa. A vacuum gas oil may be a hydrocarbon product of vacuum distillation and be abbreviated herein as "VGO".

As used herein, the term "heavy vacuum gas oil" can include one or more $C_{36}$-$C_{52}$ hydrocarbons and boil in the range of about 490° to about 590° C. or about 340° to about 560° C. at about 101.3 KPa. The term "heavy vacuum gas oil" may be abbreviated herein as "HVGO".

As used herein, the term "medium vacuum gas oil" can include one or more $C_{26}$-$C_{36}$ hydrocarbons and boil in the range of about 400° to about 490° C. at about 101.3 KPa. The term "medium vacuum gas oil" may be abbreviated herein as "MVGO".

As used herein, the term "light vacuum gas oil" can include one or more $C_{24}$-$C_{26}$ hydrocarbons, or even one or more $C_{24}$-$C_{25}$ hydrocarbons, and boil in the range of about 370° to about 400° C. at about 101.3 KPa. The term "light vacuum gas oil" may be abbreviated herein as "LVGO".

As used herein, the term "kilopascal" may be abbreviated "KPa", and the terms "degrees Celsius" may be abbreviated "° C.".

As depicted, the process flow lines in the FIGURES can be referred to interchangeably as, e.g., lines, pipes, feeds, branches, oils, portions, products, or streams.

BRIEF DESCRIPTION OF THE DRAWING

The FIGURE is a schematic, cross-sectional depiction of an exemplary apparatus.

DETAILED DESCRIPTION

Referring to the FIGURE, an exemplary hydroprocessing apparatus 100 can include a vacuum distillation column 160, a hydroprocessing zone 200 and a plurality of lines 260 communicating the vacuum distillation column 160 to the hydroprocessing zone 200. The plurality of lines 260 may include lines 264, 274, and 284 and may also be referred to as streams, as discussed hereinafter. Usually, an atmospheric bottom stream 80 is heated by a vacuum column charge furnace 110 and provided to the vacuum distillation column 160. Generally, the vacuum distillation column 160 has one or more packed beds 170, namely a first packed bed 174, a second packed bed 178, a third packed bed 182, and a fourth packed bed 186. The vacuum distillation column 160 can facilitate boiling and distillation of the atmospheric bottom stream 80 by lowering the pressure, thereby producing a VGO. A steam stream 120 can also enter the vacuum distillation column 160 to facilitate the distillation. In this exemplary embodiment, the VGO can be split into an LVGO stream 274, an MVGO stream 264, and an HVGO stream 284.

Typically, the atmospheric bottom stream 80 undergoes vacuum distillation and is thereby separated into a number of cuts. Generally, the lightest weight cut is removed from the top of the vacuum distillation column 160 in an overhead stream 130 and another cut near the top of the vacuum distillation column 160 can exit as a diesel stream 134. A bottom portion can be removed as a vacuum residue stream 138 for further processing.

The streams 264, 274, and 284 can be withdrawn at several locations, namely a first location 270, a second location 280, and a third location 290 downstream of, respectively, the third packed bed 182, the second packed bed 178, and the fourth packed bed 186 in the vacuum distillation column 160. Generally, the first location 270 is at a lower elevation on the vacuum distillation column 160 than the second location 280, and the third location 290 is at a lower elevation on the vacuum distillation column 160 than the second location 280 and the first location 270.

The first stream, first VGO, or MVGO stream 264 can include, optionally at least about 25%, by weight, one or more $C_{26}$-$C_{36}$ hydrocarbons at a temperature of about 430° to about 450° C.; the second stream, second VGO, or LVGO stream 274 can include, optionally at least about 25%, by weight, one or more $C_{24}$-$C_{25}$, or $C_{24}$-$C_{26}$ hydrocarbons at a temperature of about 370° to about 390° C.; and the third stream, third VGO, another VGO, or HVGO stream 284 including at least about 25%, by weight, one or more $C_{36}$-$C_{52}$ hydrocarbons at a temperature of about 510° to about 530° C. These streams 264, 274, and 284 can be provided to the hydroprocessing zone 200 with the third or HVGO stream 284 first being sent to a reactor charge furnace 146. A recycle gas stream 300 including hydrogen can be added to the first stream 264, the second stream 274, and the third stream 284 via respective branches 308, 312, and 304.

The hydroprocessing zone 200 can receive the streams 264, 274, and/or 284. The hydroprocessing zone 200 can contain a hydroprocessing reactor 210 having at least two beds 220, and in this exemplary embodiment can have three beds, namely a first bed 230, a second bed 240, and a third bed 250. A gas stream 316 can be split from the recycle gas stream 300 and further divided into a first recycle gas quench stream 320 and a second recycle gas quench stream 330. Control valves 324 and 334 and respective temperature indicator controllers 328 and 338 regulate the quench gas flows. Typically, the quench gases are used to reduce temperatures in the beds 240 and 250. The hydroprocessing reactor 210 may operate at a temperature of about 380° to about 440° C., and a pressure of about 16,000 to about 18,500 KPa. The temperature differential across beds 230, 240, or 250 may be about 5° to about 45° C.

Suitable hydrotreating catalysts can be any known conventional hydrotreating catalysts and include those which may be comprised of at least one metal of groups 8-10 of the periodic table, preferably iron, cobalt and nickel, and at least one metal of group 6 of the periodic table, preferably molybdenum and tungsten, on a high surface area support material, preferably alumina. Other suitable hydrotreating catalysts can include zeolitic catalysts, as well as noble metal catalysts where the noble metal may be selected from palladium and platinum. More than one type of hydrotreating catalyst can be used in the hydroprocessing reactor 210, and a catalyst having at least some hydrocracking properties may be included as well. The metal of groups 8-10 is typically present in an amount ranging from about 2 to about 20%, by weight, and the metal of group 6 is typically in an amount ranging from about 1 to about 25%, by weight. The catalyst in each bed 230, 240, or 250 may be a combination of treating and cracking types depending on the quality of the feed, which often, in turn, depends upon the type of crude being processed upstream. The catalyst quantity in each bed can be selected to meet the desired product specification.

In operation, the vacuum distillation column 160 can provide the MVGO stream 264, the LVGO stream 274, and the HVGO stream 284. In some embodiments, the entire VGO stream can be fed through a furnace, heated, and transferred into a hydrotreating and/or hydrocracking apparatus. Generally, a VGO may contain heteroatoms, such as sulfur, nitrogen and metals, such as iron, vanadium, and nickel. Such heteroatoms are generally undesired in a fuel source. Often, heteroatom content typically increases as the true boiling point range increases, so usually the HVGO stream 284 has a higher content of heteroatoms, such sulfur and nitrogen, than the MVGO stream 264, which in turn has a higher content of heteroatoms, such as sulfur and nitrogen, than the LVGO stream 274.

Usually, the HVGO stream 284 is heated in the reactor charge furnace 146 before entering the hydroprocessing reactor 210 upstream of the first bed 230, and thus, can receive the most hydroprocessing. The MVGO stream 264, which typically requires less hydroprocessing than the HVGO stream 284, is routed downstream of the first bed 230 and upstream of the second bed 240. The LVGO stream 274, which typically requires less treatment than the HVGO and the MVGO streams 284 and 264, is routed downstream of the second bed 240 and upstream of the third bed 250. Accordingly, the MVGO and LVGO streams 264 and 274, rather than receiving full treatment along with the HVGO stream 284, receive less treatment based upon their composition. This routing of streams 264, 274, and 284 can minimize use of the reactor charge furnace 146 and beds 230 and 240, resulting in increased efficiency and lowered costs of operation. Moreover, the LVGO stream 274 and the MVGO stream 264 can serve as liquid quenches, lessening the requirements of the recycle gas quench streams 320 and 330, resulting in cost savings and greater efficiency of operation. After treatment and cracking, a reactor effluent 340 can be withdrawn for further processing.

The embodiments disclosed herein can be obtained by modifying an existing hydrotreating apparatus. Particularly, the lines 264, 274, 284 can be arranged so only the HVGO line 284 is coupled to the reactor charge furnace 146. With only the HVGO portion of the VGO provided to the furnace, the operating pressure on the furnace may be reduced. What is more, the capacity of the furnace may be increased by heating only the HVGO stream instead of the entire VGO stream.

The numbers and arrangement of a number of components disclosed herein can be modified. As an example, the vacuum distillation column 160 can have any suitable number of packed beds. Likewise, the hydroprocessing reactor 210 can have any suitable number of beds, such as two beds. In such an instance, the MVGO quenching may be downstream of the first bed, and LVGO quenching downstream of the second bed. Additionally, the MVGO cut can also be split and mixed with the LVGO and HVGO cuts to further optimize the feed quality depending on the existing reactor bed catalyst loadings.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A hydroprocessing apparatus, comprising:

A) a vacuum distillation column;

B) a hydroprocessing reactor, comprising:

1) a first bed;

2) a second bed; and 3) a third bed; and

C) a plurality of lines, comprising:

1) a first line for withdrawing a first stream from a first location in the vacuum distillation column and communicating the first stream downstream of the first bed; and 2) a second line for withdrawing a second stream from a second location in the vacuum distillation column and communicating the second stream downstream of the second bed; wherein the first location is at a lower elevation on the vacuum distillation column than the second location.

2. The hydroprocessing apparatus according to claim 1, wherein the plurality of lines further comprises a third line for withdrawing a third stream from a third location in the vacuum distillation column and communicating the third stream upstream of the first bed wherein the third location is at a lower elevation on the vacuum distillation column than the second location.

* * * * *